US011135866B2

(12) United States Patent
Tsai et al.

(10) Patent No.: US 11,135,866 B2
(45) Date of Patent: Oct. 5, 2021

(54) METHOD OF PERFORMING FOIL SLEEKING AFTER PRINTING FOR UV INKJET PRINTER

(71) Applicant: GREAT COMPUTER CORP., New Taipei (TW)

(72) Inventors: Chen-Chien Tsai, New Taipei (TW); Yu-Hung Tang, New Taipei (TW)

(73) Assignee: GREAT COMPUTER CORP., New Taipei (TW)

( * ) Notice: Subject to any disclaimer, the term of this patent is extended or adjusted under 35 U.S.C. 154(b) by 0 days.

(21) Appl. No.: 16/852,898

(22) Filed: Apr. 20, 2020

(65) Prior Publication Data

US 2021/0197609 A1 Jul. 1, 2021

(30) Foreign Application Priority Data

Dec. 27, 2019 (TW) ..... 108148175

(51) Int. Cl.

| | |
|---|---|
| ***B41M 7/00*** | (2006.01) |
| ***B41J 11/00*** | (2006.01) |
| *B44C 1/10* | (2006.01) |
| *B41F 19/00* | (2006.01) |

(52) U.S. Cl.

CPC ..... *B41M 7/0045* (2013.01); *B41J 11/002* (2013.01); *B41J 11/0015* (2013.01); *B41F 19/004* (2013.01); *B44C 1/105* (2013.01)

(58) Field of Classification Search

CPC .. B41M 7/0045; B41J 11/0015; B41J 11/002; B41F 19/004; B44C 1/105

See application file for complete search history.

(56) References Cited

U.S. PATENT DOCUMENTS

2018/0072045 A1* 3/2018 Kosalla ..... B44C 1/14
2018/0311997 A1* 11/2018 Triepel ..... B41F 19/007

* cited by examiner

*Primary Examiner* — Yaovi M Ameh

(74) *Attorney, Agent, or Firm* — Muncy, Geissler, Olds & Lowe, P.C.

(57) ABSTRACT

A method of performing foil sleeking after printing for UV inkjet printer is disclosed, which comprises steps of: positioning a workpiece with printed patterns or words; then printing an undercoat layer on areas to be foil-sleeked of the patterns or words, then irradiate the undercoat by a UV lamp with a low irradiation intensity to allow the undercoat layer to form a viscosity; and finally sticking a foil on the undercoat layer.

4 Claims, 2 Drawing Sheets

METHOD OF PERFORMING FOIL SLEEKING AFTER PRINTING FOR UV INKJET PRINTER

FIELD OF THE INVENTION

The present invention relates to a method of performing foil sleeking after printing for UV inkjet printer which is a simple process with high efficiency and low cost.

BACKGROUND OF THE INVENTION

UV inkjet printers have been widely used in professional commercial output applications (e.g. advertisements, posters, high-quality art reproductions etc.) because they allow printing on various types and thicknesses of materials at relatively high printing speeds and has stable and uniform printing quality. With its reliable performance, the time and labor invested in preparing color separation plates is eliminated, which enables faster printing.

In commercially available UV inkjet printers at present, an inkjet module controlled to travel back and forth is provided on a sliding platform of the machine. A plurality of inkjet cartridges are provided on the inkjet module and a plurality of print heads corresponding to the respective inkjet cartridges are provided at the bottom of the inkjet module. Inks are ejected from nozzles located at the bottom of the print heads onto a substrate to be printed. The inks jetted on the substrate to be printed are then quickly hardened/cured by subjecting them to UV light from a UV lamp provided at a side of the inkjet module. During printing of the substrate, a region of interest traditionally can be printed using a unidirectional printing method or a bi-directional printing method to save print time.

Further, a foil sleeking technique is generally a post-print process for applying gold foil or metallic foil onto a printed article to enhance its exterior texture and additional value. As the UV inkjet printing technique is already mature and become popular, the accomplished product by combining both the foil sleeking technique and UV inkjet printing technique is in the spotlight for its appearance. Currently the UV inkjet printing technique mainly cooperate with the hot foil sleeking technique, whereas the temperature for hot foil sleeking is at a range of 130° C. to 150° C. Accordingly, before the UV inkjet printed patterns or words pass through the hot foil sleeking machine, the whole workpiece has to be laminated over its surface, so as to form a protecting film over the UV inkjet printed patterns or words, followed by repeating the UV inkjet printing procedure for printing the patterns or words again on the area to be foil-sleeked. Eventually the hot foil sleeking procedure is done on the re-printed patterns or words, so as to adhere foil on partial regions and prevent the foil from sticking to undesired regions during the hot foil sleeking procedure.

SUMMARY OF THE INVENTION

However, the above procedures have to form a protective film and re-print the patterns or words before the hot foil sleeking procedure, which are time consuming and too costly. Such complicated procedures cause the quality and stability of the finished product greatly reduced. Therefore, there is a need in the art for an improvement that is able to effectively operate both the procedures.

An main objective of the present invention is to provide a method of performing foil sleeking after printing for UV inkjet printer which provides a simple process with high efficiency and low cost.

Another objective of the present invention is to provide a method of performing foil sleeking after printing for UV inkjet printer which performs with high quality and stability and there is no need for protective coating before the foil sleeking.

To achieve the abovementioned objectives, the method of performing foil sleeking after printing for UV inkjet printer comprises the steps of:

(a) positioning a workpiece with printed patterns or words;

(b) printing an undercoat layer on areas to be foil-sleeked of the patterns or words, then irradiate the undercoat by a UV lamp in a low irradiation intensity to allow the undercoat layer to form a viscosity; and (c) sticking a foil on the undercoat layer.

In implementation, the method further comprises a step (a1) between the step (a) and the step (b) of printing transparent inks on the areas to be foil-sleeked of the patterns or words and curing the transparent inks by the UV lamp. The irradiation intensity of the UV lamp in step (b) is lower than the irradiation intensity of the UV lamp in step (a1).

In implementation, the foil is adhered onto the undercoat layer after being pressed by a pressing device.

In implementation, the undercoat is of UV inks.

Other objects, advantages and novel features of the present invention will become more apparent from the following detailed description when taken in conjunction with the accompanying drawings.

DETAILED DESCRIPTION

Figure 1:
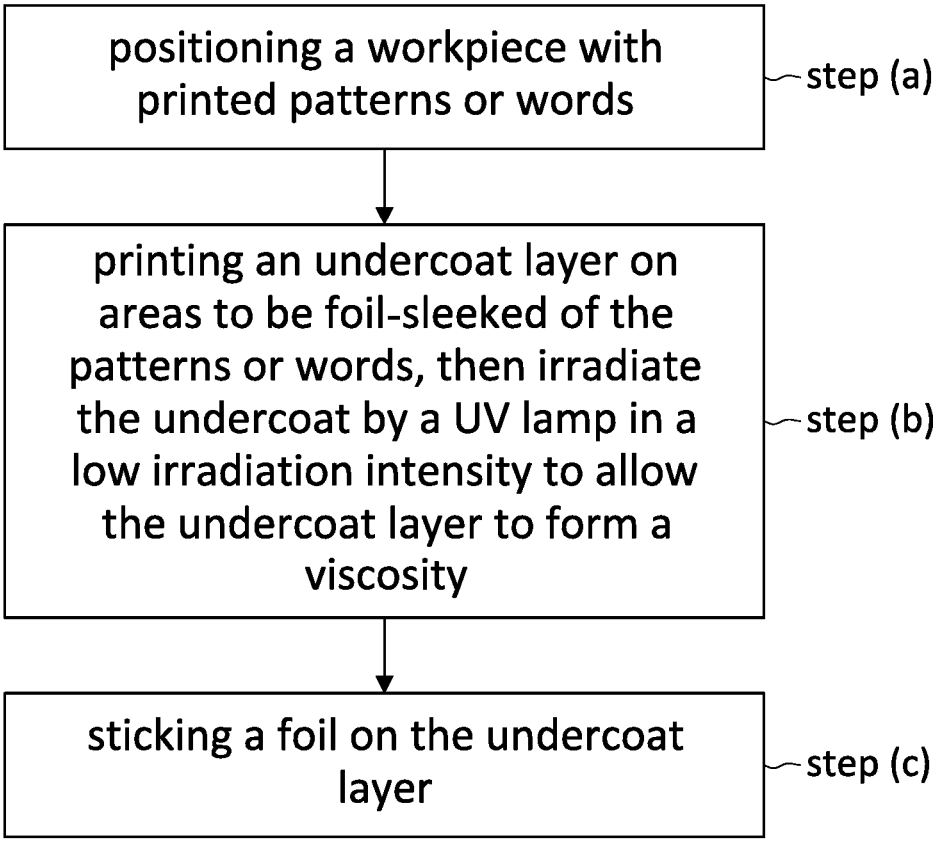
FIG. 1 is a flowchart showing an embodiment of the present invention.

Referring to FIG. 1, a method of performing foil sleeking after printing for UV inkjet printer of a preferred embodiment of the present invention is disclosed.

The method of performing foil sleeking after printing for UV inkjet printer of the present invention comprises following steps:

step (a): positioning a workpiece with printed patterns or words thereon;

step (b): printing an undercoat layer on areas to be foil-sleeked of the patterns or words, then irradiate the undercoat by a UV lamp in a low irradiation intensity to allow the undercoat layer to form a viscosity; and step (c): sticking a foil on the undercoat layer.

Wherein the foil is adhered onto the undercoat layer after being pressed by a pressing device, and the undercoat is of UV inks.

Therefore, when this embodiment is implemented, since the undercoat layer on the areas to be foil-sleeked of the patterns or words is irradiated by a low light intensity of ultraviolet light emitted from the UV lamp, the undercoat layer becomes viscous to allow the foil to adhere to the undercoat layer (i.e., the areas to be foil-sleeked) without sticking onto areas other than the patterns or words on the workpiece.

Figure 2:
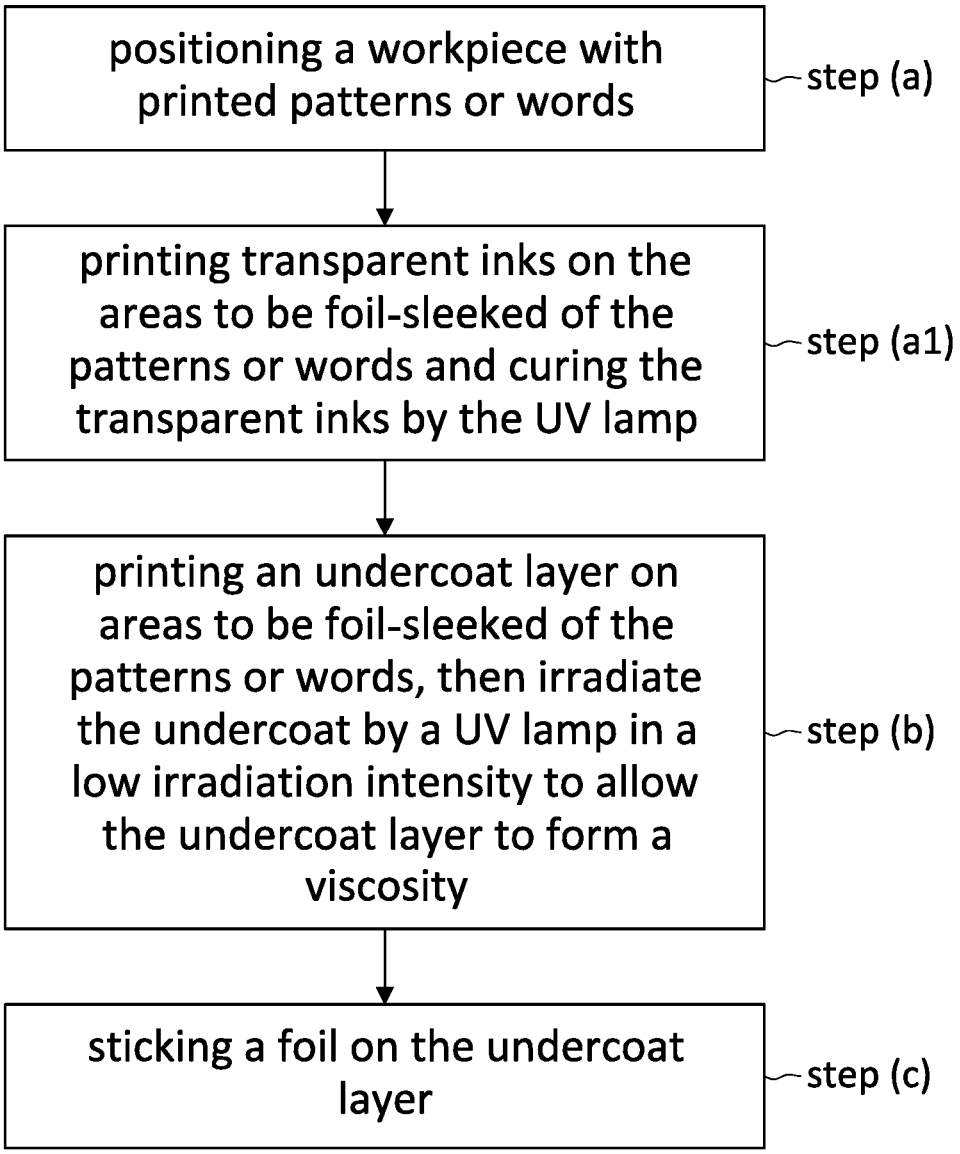
FIG. 2 is a flowchart showing another embodiment of the present invention.

Further, as shown in FIG. 2, the present invention can further comprise a step (a1) between the step (a) and the step (b) of printing transparent inks on the areas to be foil-sleeked of the patterns or words and curing the transparent inks by the UV lamp. The irradiation intensity of the UV lamp in step (b) is lower than the irradiation intensity of the UV lamp in step (a1). Therefore, when this embodiment is implemented, since the transparent inks on the areas to be foil-sleeked of the patterns or words is cured by the ultraviolet light emitted from the UV lamp, a transparent film is formed by the cured transparent inks. Moreover, since irradiation intensity of the UV lamp in step (b) is lower than the irradiation intensity of the UV lamp in step (a1), the undercoat layer in step (b) can have a viscosity to allow the foil to adhere to the undercoat layer (i.e., the areas to be foil-sleeked) without sticking onto areas other than the patterns or words on the workpiece.

By the design mentioned above, the undercoat layer can generate viscosity when irradiated at a low irradiation intensity and heated at a low temperature, so as to allow the foil to adhere thereon without forming a protective coating over the whole workpiece as the conventional means do. Therefore, not only the cost is lowered and the efficiency becomes higher, the present invention can effectively prevent the foil from sticking to undesired areas on the workpiece, and consequently obtain a huge improvement on the stability and precision of the procedure.

The exemplary embodiments have been illustrated; however, the method of performing foil sleeking after printing for UV inkjet printer according to the present invention is not limited thereto. According to modifications or combinations of the embodiments, various types of methods of performing foil sleeking after printing for UV inkjet printer can be realized having the scope of the present invention and thus without departing from the technical spirit of the present invention.

As disclosed above, the present invention indeed achieves the objectives of the present invention by providing a method of performing foil sleeking after printing for UV inkjet printer. The present invention has significant values in terms of industrial applications, and a patent application is thus filed in accordance with the law.

The invention claimed is:

1. A method of performing foil sleeking after printing for UV inkjet printer, comprising the steps of:

step (a): positioning a workpiece with printed patterns or words;

step (a1): printing transparent inks on areas to be foil-sleeked of the patterns or words and completely curing the transparent inks by a UV lamp to form a transparent film;

step (b): printing an undercoat layer on the areas to be foil-sleeked of the patterns or words, then irradiate the undercoat by a UV lamp in a low irradiation intensity to allow the undercoat layer to form a viscosity, wherein the irradiation intensity of the UV lamp in step (b) is lower than an irradiation intensity of the UV lamp in step (a1); and step (c): sticking a foil on the undercoat layer.

2. The method of claim 1, wherein the foil is adhered onto the undercoat layer after being pressed by a pressing device.

3. The method of claim 1, wherein the undercoat is of UV inks.

4. The method of claim 2, wherein the undercoat is of UV inks.

* * * * *